US005642980A

United States Patent [19]

Tacchi et al.

[11] Patent Number: 5,642,980

[45] Date of Patent: Jul. 1, 1997

[54] DEVICE FOR PICKING UP STACKS OF PRODUCTS FROM A SUPPORT

[75] Inventors: Alver Tacchi; Antonio Gamberini, both of Bologna, Italy

[73] Assignee: G.D. S.p.A., Bologna, Italy

[21] Appl. No.: 627,536

[22] Filed: Apr. 4, 1996

[30] Foreign Application Priority Data

Apr. 28, 1995 [IT] Italy ..... BO95A0188

[51] Int. Cl.[6] ..... B65G 59/02

[52] U.S. Cl. ..... 414/796.9; 414/796

[58] Field of Search ..... 414/622, 751, 414/792.9, 796, 796.9

[56] References Cited

U.S. PATENT DOCUMENTS 5,169,284 12/1992 Berger et al. ..... 414/796.9
5,417,543 5/1995 Focke et al. ..... 414/796.9

FOREIGN PATENT DOCUMENTS 0363722 4/1990 European Pat. Off. .
0532950 3/1993 European Pat. Off. .
0532949 3/1993 European Pat. Off. .
0581188 2/1994 European Pat. Off. .

*Primary Examiner*—Karen B. Merritt
*Assistant Examiner*—Janice L. Krizek
*Attorney, Agent, or Firm*—Guido Modiano; Albert Josif

[57] ABSTRACT

The device for picking up stacks of products from a support has a head for picking up a stack of products from a supporting platform, and is provided with presser elements for pressing on the stack. The presser elements act in an upward region of the stack and with a flexible lamina that is adapted to fit between the stack and the supporting platform. Additional presser elements are supported by the pick-up head to act on the stack, whereby to take the weight of the stack off the supporting platform and facilitate the insertion of the lamina between the platform and the stack of products.

14 Claims, 1 Drawing Sheet

DEVICE FOR PICKING UP STACKS OF PRODUCTS FROM A SUPPORT

BACKGROUND OF THE INVENTION

The present invention relates to a device for picking up stacks of products from a support.

In particular, the invention relates to a device for picking up individual stacks of cardboard cutouts, generally arranged on a pallet-like support in a plurality of rows and in a plurality of layers separated by supporting platforms constituted for example by a sheet of cardboard of appropriate thickness. In order to pick up individual stacks of cutouts, such as for example those used to package cigarette packs of the flip-top type, a device is known which comprises a thin lamina that is partially flexible and is inserted between a stack to be picked up and an underlying supporting platform.

The lamina is slideably supported at the base of a pick-up head which can move along perpendicular axes and has a bracket that is mounted above it and protrudes above the lamina.

The bracket supports presser elements that can be actuated, along vertical axes, by corresponding actuation means, and also supports, above the lamina, a photocell for checking the centering of the pick-up head with respect to the stack of cutouts to be picked up.

Once said centering has occurred, the pick-up head is lowered until appropriate sensor means detect contact with the platform that supports the stack.

At this point the presser elements are activated and move down so as to lock the stack of cutouts, while the lamina is advanced in order to be inserted between the platform and the stack; said stack is therefore clamped between said lamina and further presser elements that are mounted on said bracket.

Then the pick-up head is actuated in a conventional manner to lift the stack from the pallet and to transfer said stack to the inlet of a user machine.

In the operation of the above-described conventional pick-up device, the operation for inserting the lamina between the stack and the supporting platform is very difficult. The lamina jams against the edges of the lowermost cutouts of the stack, thereby damaging said cutouts.

This difficult insertion also does not ensure that all the cutouts of the stack are picked up correctly.

SUMMARY OF THE INVENTION

An aim of the present invention is to provide a pick-up device that does not have the above described drawback.

An object of the present invention is to provide a pick-up device that is simple in concept and has a low cost.

The present invention provides a device for picking up stacks of products from a support as defined in the appended claims.

The device according to the invention has a head for picking up a stack of products from a supporting platform, said head being movable along perpendicular axes; means for pressing on said stack, which are mounted on a bracket supported by said head and are adapted to act in an upward region of said stack; a flexible lamina that is mounted for sliding, with a reciprocating motion, at the base of said head and adapted to fit between said stack and said platform. The device comprises additional presser means adapted to act on said stack so as to take the weight of said stack off said platform at least at the region for the insertion of said lamina between the stack and said platform.

Preferably, said additional presser means are supported by said head, are arranged symmetrically at the sides of said flexible lamina, and are adapted to laterally engage said stack.

BRIEF DESCRIPTION OF THE DRAWINGS

The invention is now described with reference to the accompanying drawing, which illustrates a non-limitative example of embodiment thereof, wherein.

DESCRIPTION OF THE PREFERRED EMBODIMENTS

Figure 1:
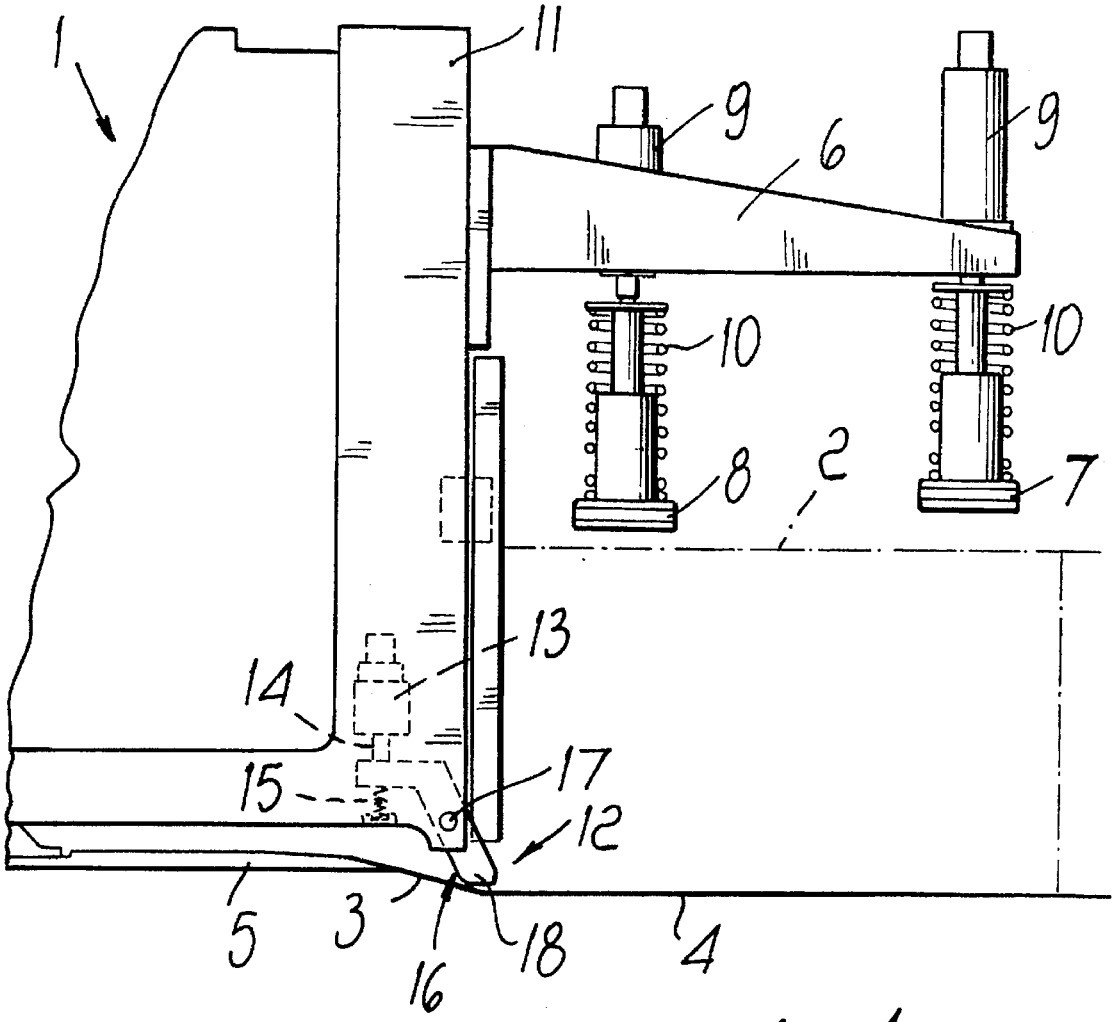
FIG. 1 is a partial longitudinal elevation view of a pick-up device according to the present invention.

With reference to FIG. 1, the reference numeral 1 designates a head for picking up stacks 2 of cutouts, such as for example those used to package cigarette packs of the rigid flip-top type.

The pick-up head 1 can move, in a conventional manner, along perpendicular axes, so that it is centered with respect to the stack 2 of cutouts to be picked up.

The pick-up head 1 comprises a thin flexible lamina 3 that is adapted to penetrate between the stack 2 to be picked up and a supporting platform 4; said lamina 3 is fixed, at the front, to a blade 5 that is mounted so that it can slide with a reciprocating motion at the base of the pick-up head 1.

The pick-up head 1 supports, in an upward region, a bracket 6 that is mounted thereon and protrudes above the lamina 3; said bracket 6 supports a first presser element 7 and a second presser element 8, both of which can be moved, along vertical axes, by respective actuator elements 9 with the interposition of respective helical springs 10.

The pick-up head 1 is frontally provided, on the front side, with two uprights 11 that are arranged symmetrically at the sides of the lamina 3.

Additional presser elements 12 are arranged between the uprights 11 and are adapted to be moved by an actuator element 13 that acts by means of a stem 14 in contrast with a spring 15.

In practice, the presser elements 12 comprise a fork 16 which is oscillatably supported by the uprights 11 by means of a horizontal pivot 17 that lies above the lamina 3.

The fork 16 is formed by two arms 18 that are arranged symmetrically to the sides of the lamina 3 and by a cross-member 19 that lies above the lamina 3 and is adapted to engage the lower end of the stem 14 of the actuator element 13.

The arms 18 act at the base of the stack 2 to be picked up, in order to take the weight of the stack 2 off the platform 4 so as to allow the lamina 3 to very easily penetrate between said stack 2 and the platform 4.

During use, first of all the pick-up head 1 is centered, by means of a photocell (not shown), above the stack 2 of cutouts to be picked up; then the head 1 is lowered until an appropriate sensor (not shown) detects its contact with the surface that supports the stack 2, i.e., with the supporting platform 4.

Figure 2:
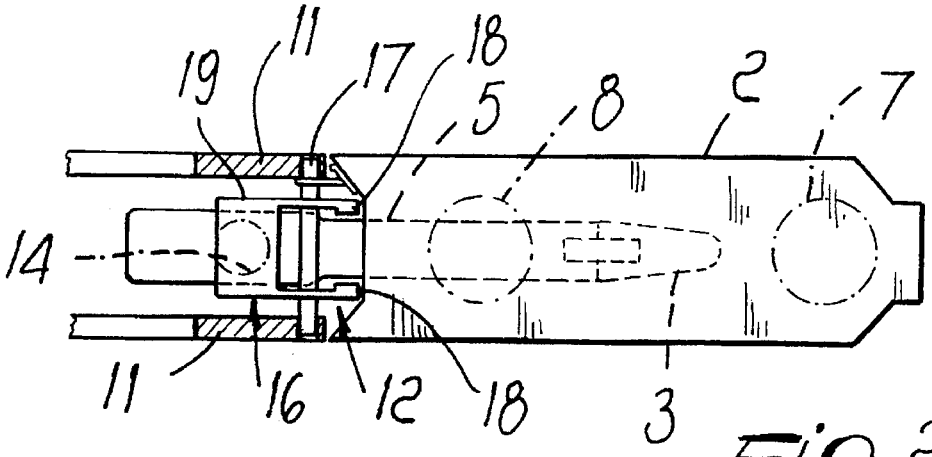
FIG. 2 is a corresponding horizontal sectional view thereof.

At this point, the lowering of the first presser 7 is actuated; said first presser acts on the stack 2 in proximity of a first end side thereof, so as to lock said stack 2 on the platform 4, and immediately thereafter the fork 16 is actuated; by laterally engaging the stack 2, at a lower region of a second end side opposite to the first end side where the first presser 7 acts, said fork eases the weight of said stack 2, at least at said second end side of the stack, up from the platform 4. This allows the flexible lamina 3, which is in the position shown in FIG. 1, to penetrate below the lowermost cutout of the stack 2, between said lowermost cutout and the platform 4, as shown in FIG. 2.

After the insertion of the blade 5 and of the lamina 3 under the stack 2, the first presser 7 is raised, whereas the second presser 8 is lowered to act on the stack 2, which is therefore gripped by the pick-up head 1, and clamped between the blade 5 and the second presser 8.

Finally, the pick-up head 1 is actuated, in a known manner that is not shown, so as to lift the stack 2 and transfer said stack 2 to the inlet (not shown) of a user machine (not shown).

The present invention is susceptible of numerous modifications and variations, all of which are within the scope of the inventive concept.

All the details may be replaced with other technically equivalent ones.

All details and dimensions may be any according to the requirements.

What is claimed is:

1. Device for picking up stacks of products from a platform, comprising:

a head for picking up a stack of products from said platform, said head being movable along perpendicular axes and including a supporting bracket;

presser elements for pressing on an upper region of said stack, said presser elements being mounted on said bracket of said heed and being operatable for acting independently on said upper region, at least in proximity of a first end, side of said stack;

a flexible lamina-mounted at a lower base of said head, said lamina being slidingly movable with a reciprocating motion at the base of said head to fit in an insertion region between said stack and said platform; and additional presser elements operatable for engaging a lower region of a second end side of the stack, said second end side of the stack engageable by said additional presser means being opposite to said first end side; and wherein said additional presser elements exert on said stack a pressure for easing said second end side up from said platform at least at the region of insertion of said lamina between, the stack and said platform.

2. Device according to claim 1, comprising a blade, said blade being slidingly movable at the base of said head with a reciprocating motion, said flexible lamina being fixed at a front part of said blade so as to be movable along with the blade.

3. Device according to claim 1, wherein two presser elements are provided for acting independently on the upper region of the stack in proximity of said first end side to lock the stack against said platform and, respectively, in proximity of said second opposite end side of the stack for gripping the stack.

4. Device according to claim 1, wherein said additional presser elements are arranged symmetrically at longitudinal sides of said flexible lamina, and are supported by said head.

5. Device according to claim 4, further comprising actuator means for actuating said additional presser elements.

6. Device according to claim 5, wherein said actuator means comprises a stem and a spring, said additional presser elements comprising a fork formed by two arms arranged symmetrically at the sides of said flexible lamina and a cross-member lying above said lamina, said stem of said actuator means acting on said cross-member of the additional presser elements in contrast with said spring.

7. Device according to claim 6, wherein said head comprises uprights arranged symmetrically with respect to said lamina, said fork of said additional presser elements being oscillatably supported by said uprights and being actuatable by said stem to engage said lower region of said second end side of the stack so as to ease said second end side up from said platform, at least at the region of insertion of said lamina between the stack and said platform.

8. In combination a pickup head being movable along perpendicular axes for picking up stacks of products from a supporting platform, the head comprising:

a supporting bracket;

presser elements being mounted on said bracket for pressing on an upper region of a stack, said presser elements being operatable for acting independently on said upper region, at least in proximity of a first end side of said stack;

a flexible lamina mounted at a lower base of the head, said lamina being slidingly movable with a reciprocating motion at the base of said head to fit in an insertion region between said stack and said platform; and additional presser elements being operatable at a lower region of a second end side of the stack which is opposite to said first end side, said additional presser elements exerting at said lower region of the said second end side of said stack, while said presser elements press on said upper region at least in proximity of the first end side of the stack, a pressure for easing said second end side up from said platform at least at the region of insertion of said lamina between the stack and said platform.

9. The combination of claim 8, wherein said additional presser elements are arranged symmetrically at longitudinal sides of said flexible lamina, and are supported by said head.

10. The head of claim 8, further comprising a blade, said blade being slidingly movable at the base of said head with a reciprocating motion, said flexible lamina being fixed at a front part of said blade so as to be movable along with the blade.

11. The head of claim 8, wherein two presser elements are provided for acting independently on the upper region of the stack in proximity of said first end side to lock the stack against said platform and, respectively, in proximity of said second opposite end side of the stack for gripping the stack.

12. The head of claim 8, further comprising actuator means for actuating said additional presser elements.

13. The head of claim 12, wherein said actuator means comprises a stem and a spring, said additional presser elements comprising a fork formed by two arms arranged symmetrically at the sides of said flexible lamina and a cross-member lying above said lamina, said stem of said actuator means acting on said cross-member of the additional presser elements in contrast with said spring.

14. The head of claim 13, comprising uprights arranged symmetrically with respect to said lamina, said fork of said additional presser elements being oscillatably supported by said uprights and being actuatable by said stem to engage said lower region of said second end side of the stack so as to ease said second and side up from said platform, at least at the region of insertion of said lamina between the stack and said platform.

* * * * *